US012000398B2

(12) United States Patent
Nemit, Jr. et al.

(10) Patent No.: US 12,000,398 B2
(45) **Date of Patent: *Jun. 4, 2024**

(54) VOLUME RATIO CONTROL SYSTEM FOR A COMPRESSOR

(71) Applicant: Johnson Controls Tyco IP Holdings LLP, Milwaukee, WI (US)

(72) Inventors: Paul Nemit, Jr., Greencastle, PA (US); Angela Marie Comstock, Roanoke, VA (US); Franklin Aaron Montejo, York, PA (US)

(73) Assignee: TYCO FIRE & SECURITY GMBH, Schaffhausen (CH)

( * ) Notice: Subject to any disclaimer, the term of this patent is extended or adjusted under 35 U.S.C. 154(b) by 0 days.

This patent is subject to a terminal disclaimer.

(21) Appl. No.: 17/791,180

(22) PCT Filed: Jan. 7, 2021

(86) PCT No.: PCT/US2021/012449

§ 371 (c)(1),
(2) Date: Jul. 6, 2022

(87) PCT Pub. No.: WO2021/142085

PCT Pub. Date: Jul. 15, 2021

(65) Prior Publication Data

US 2023/0029703 A1 Feb. 2, 2023

Related U.S. Application Data

(60) Provisional application No. 62/958,180, filed on Jan. 7, 2020.

(51) Int. Cl.

| | |
|---|---|
| ***F04C 18/16*** | (2006.01) |
| ***F04C 28/12*** | (2006.01) |
| ***F25B 41/39*** | (2021.01) |

(52) U.S. Cl.
CPC ..... *F04C 18/16* (2013.01); *F04C 28/12* (2013.01); *F25B 41/39* (2021.01);
(Continued)

(58) Field of Classification Search
CPC .... F04C 18/16; F04C 28/12; F25B 2339/047; F25B 2400/13; F25B 2600/0253; F25B 41/39
See application file for complete search history.

(56) References Cited

U.S. PATENT DOCUMENTS 3,432,089 A * 3/1969 Benedictus ..... F02B 53/00 417/310
4,042,310 A 8/1977 Schibbye et al.
(Continued)

FOREIGN PATENT DOCUMENTS

CN 1176680 A 3/1998
CN 1240017 A 12/1999
(Continued)

OTHER PUBLICATIONS

International Search Report and Written Opinion for PCT Application No. PCT/US2021/012449, dated Apr. 20, 2021, 13 pgs.
(Continued)

*Primary Examiner* — Jesse S Bogue
(74) *Attorney, Agent, or Firm* — Fletcher Yoder, PC

(57) ABSTRACT

A volume ratio control system for a compressor includes a chamber formed within a housing of the compressor, a piston disposed within the chamber, where the piston is configured to separate the chamber into at least a first portion fluidly coupled to a low pressure side of the compressor and a second portion fluidly coupled to a high pressure side of the compressor, and a biasing device disposed within the chamber, where the biasing device is configured to adjust a position of the piston in response to a pressure differential
(Continued)

between the low pressure side of the compressor and the high pressure side of the compressor falling below a threshold value.

23 Claims, 8 Drawing Sheets

(52) U.S. Cl.
CPC ..... *F25B 2339/047* (2013.01); *F25B 2400/13* (2013.01); *F25B 2600/0253* (2013.01)

(56) References Cited

U.S. PATENT DOCUMENTS

| | | | | |
|---|---|---|---|---|
| 4,515,540 | A | 5/1985 | Pilis | |
| 4,609,329 | A | 9/1986 | Pillis et al. | |
| 5,044,894 | A | 9/1991 | Field et al. | |
| 5,183,395 | A | 2/1993 | Langouet | |
| 5,240,388 | A | 8/1993 | Matsumoto et al. | |
| 5,979,168 | A * | 11/1999 | Beekman | F04C 18/16 417/310 |
| 8,641,395 | B2 * | 2/2014 | Nemit, Jr. | F04C 29/0021 418/2 |
| 9,267,720 | B2 * | 2/2016 | Choi | F25B 49/022 |
| 10,883,744 | B2 * | 1/2021 | Johnson | F25B 1/047 |
| 11,365,736 | B2 * | 6/2022 | Bi | F04C 28/12 |
| 2004/0109782 | A1 | 6/2004 | Tang et al. | |
| 2008/0260539 | A1 * | 10/2008 | Stinessen | F04D 29/104 417/34 |
| 2012/0282129 | A1 * | 11/2012 | Nemit, Jr. | F04C 18/16 418/201.1 |
| 2013/0036757 | A1 * | 2/2013 | Okaichi | F25B 1/10 62/228.3 |
| 2014/0026414 | A1 | 1/2014 | Holmes et al. | |
| 2014/0260414 | A1 | 9/2014 | Nemit, Jr. | |
| 2018/0356128 | A1 | 12/2018 | Johnson et al. | |

FOREIGN PATENT DOCUMENTS

| | | | |
|---|---|---|---|
| CN | 1745251 | A | 3/2006 |
| CN | 102042226 | A | 5/2011 |
| CN | 204267294 | U | 4/2015 |
| CN | 105579709 | A | 5/2016 |
| CN | 105715548 | A | 6/2016 |
| CN | 106122016 | A | 11/2016 |
| CN | 109458340 | A | 3/2019 |
| CN | 109715951 | A | 5/2019 |
| GB | 1335024 | A | 10/1973 |
| GB | 2295661 | B | 12/1998 |
| JP | H05187378 | A | 7/1993 |

OTHER PUBLICATIONS

Chinese Office Action for CN Application No. 202180012210.0, dated Mar. 12, 2024, 10 pages.
Chinese Office Action for CN Application No. 202180012173.3, dated Mar. 12, 2024, 9 pages.

* cited by examiner

VOLUME RATIO CONTROL SYSTEM FOR A COMPRESSOR

CROSS REFERENCE TO RELATED APPLICATION

This application is a U.S. National Stage Application of PCT International Application No. PCT/US2021/012449, entitled "VOLUME RATIO CONTROL SYSTEM FORA COMPRESSOR," filed Jan. 7, 2021, which claims priority to and the benefit of U.S. Provisional Application No. 62/958,180, entitled "VOLUME RATIO CONTROL SYSTEM FOR A COMPRESSOR," filed Jan. 7, 2020, each of which is hereby incorporated by reference in its entirety for all purposes.

BACKGROUND

This section is intended to introduce the reader to various aspects of art that may be related to various aspects of the present disclosure, which are described below. This discussion is believed to be helpful in providing the reader with background information to facilitate a better understanding of the various aspects of the present disclosure. Accordingly, it should be understood that these statements are to be read in this light, and not as admissions of prior art.

HVAC&R systems are used in a variety of settings and for many purposes. For example, HVAC&R systems may include a vapor compression refrigeration cycle (e.g., a refrigerant circuit having a condenser, an evaporator, a compressor, and/or an expansion device) configured to condition an environment. The vapor compression refrigeration cycle may include a compressor that is configured to direct refrigerant through various components of the refrigerant circuit. In some cases, a pressure of refrigerant at various positions along the refrigerant circuit may fluctuate during operation of the vapor compression refrigeration cycle. Accordingly, a compression ratio (e.g., a ratio between a low or suction pressure and a high or discharge pressure) of the compressor may be adjusted to maintain operating parameters of the vapor compression refrigeration cycle at target levels. To adjust the compression ratio of the compressor, a speed of one or more rotors of the compressor may be adjusted via a motor or another suitable drive. Additionally, a volume ratio of the compressor may be adjusted based on the compression ratio to maintain a performance of the compressor.

Existing compressors may be configured to adjust the volume ratio in response to a given compression ratio via stepwise control of a piston between one or more positions. Additionally or alternatively, a proportional valve may be utilized to supply a fluid into a piston chamber to adjust the position of the piston. Unfortunately, existing techniques for controlling the volume ratio of the compressor may be limited based on the finite number of positions of the piston and/or may increase costs by including additional components, such as the proportional valve and corresponding control devices.

SUMMARY

In an embodiment of the present disclosure, a volume ratio control system for a compressor includes a chamber formed within a housing of the compressor, a piston disposed within the chamber, where the piston is configured to separate the chamber into at least a first portion fluidly coupled to a low pressure side of the compressor and a second portion fluidly coupled to a high pressure side of the compressor, and a biasing device disposed within the chamber, where the biasing device is configured to adjust a position of the piston in response to a pressure differential between the low pressure side of the compressor and the high pressure side of the compressor falling below a threshold value.

In another embodiment of the present disclosure, a heating, ventilation, air conditioning, and/or refrigeration (HVAC&R) system includes a compressor configured to circulate a refrigerant through a refrigerant circuit and a volume ratio control system configured to adjust a volume ratio of the compressor. The volume ratio control system includes a chamber, a piston disposed within the chamber, where the piston is configured to separate the chamber into at least a first portion fluidly coupled to a low pressure side of the compressor and a second portion fluidly coupled to a high pressure side of the compressor, and a biasing device disposed within the chamber, where the biasing device is configured to enable movement of the piston in response to a pressure differential between the low pressure side of the compressor and the high pressure side of the compressor falling below a threshold value.

In a further embodiment of the present disclosure, a volume ratio control system for a compressor includes a chamber formed within a housing of the compressor, a piston disposed within the chamber, where the piston is configured to separate the chamber into a first portion fluidly coupled to a low pressure side of the compressor, a bypass portion fluidly coupled to a high pressure side of the compressor, and a second portion fluidly coupled to the bypass portion and/or a lubricant line, and a biasing device disposed within the chamber, where the biasing device is configured to enable movement of the piston in response to a pressure differential between the low pressure side of the compressor and the high pressure side of the compressor falling below a threshold value.

DRAWINGS

DETAILED DESCRIPTION

Figure 1:
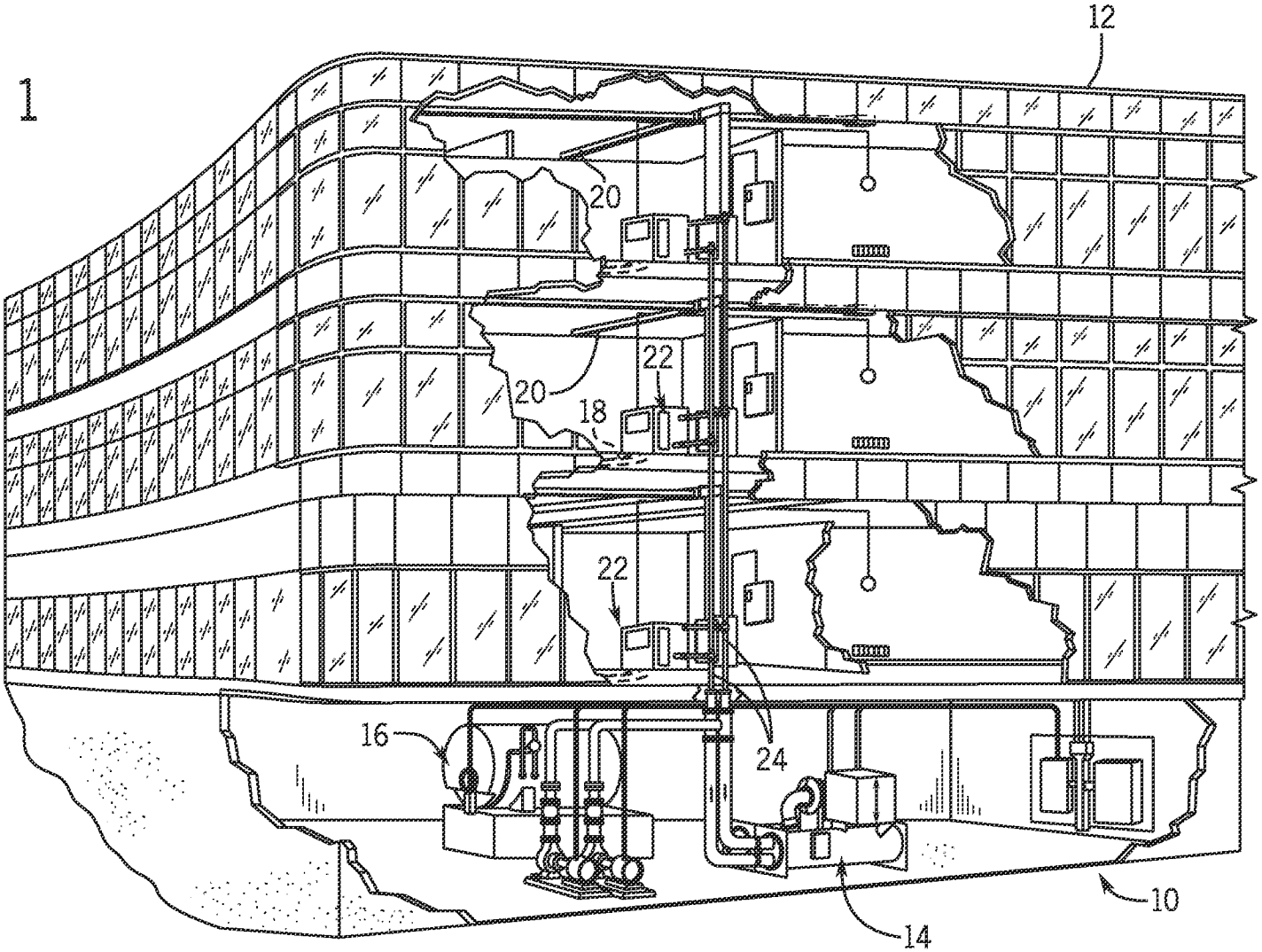
FIG. 1 is a perspective view of a building that may utilize an embodiment of a heating, ventilation, air conditioning, and/or refrigeration (HVAC&R) system in a commercial setting, in accordance with an aspect of the present disclosure.

One or more specific embodiments of the present disclosure will be described below. These described embodiments are only examples of the presently disclosed techniques. Additionally, in an effort to provide a concise description of these embodiments, all features of an actual implementation may not be described in the specification. It should be appreciated that in the development of any such actual implementation, as in any engineering or design project, numerous implementation-specific decisions must be made to achieve the developers' specific goals, such as compliance with system-related and business-related constraints, which may vary from one implementation to another. Moreover, it should be appreciated that such a development effort might be complex and time consuming, but would nevertheless be a routine undertaking of design, fabrication, and manufacture for those of ordinary skill having the benefit of this disclosure.

As discussed above, a vapor compression refrigeration cycle may include a compressor that is configured to circulate a refrigerant through a refrigerant circuit of the vapor compression refrigeration cycle. In some cases, various operating parameters of the refrigerant may fluctuate during operation of the vapor compression refrigeration cycle. As such, a compression ratio of the compressor may be adjusted in order to maintain and/or adjust operating parameters of the refrigerant within the refrigerant circuit toward target levels. The compression ratio of the compressor may be controlled via a motor that supplies torque to one or more rotors of the compressor. Therefore, an operating speed of the motor may be adjusted in order to control the compression ratio to achieve a target value. Further, a volume ratio of the compressor may be adjusted based on the compression ratio in order to maintain a desired performance (e.g., an efficiency) of the compressor during operation. Indeed, in some cases, an amount of refrigerant drawn into the compressor may exceed an amount that achieves the target compression ratio. Accordingly, the volume ratio may be adjusted by enabling refrigerant to bypass a compression portion (e.g., a portion of a compression chamber) of the compressor to reduce the volume ratio. Similarly, an amount of refrigerant drawn into the compressor may be less than an amount that achieves the target compression ratio. In such instances, the volume ratio may be adjusted by blocking refrigerant from bypassing the compression portion in order to increase the volume ratio of the compressor.

Existing compressors may control volume ratio of the compressor using a piston that may be adjusted between a finite number of positions. For example, the piston may be in fluid communication with a high pressure side, such as a discharge side, of the compressor to enable the refrigerant to bypass the compression portion of the compressor based on the position of the piston. Further, some existing compressors may include a proportional valve that directs a working fluid toward a piston chamber to generate movement of the piston, thereby providing control over the position of the piston. However, such existing systems may be limited in controlling the volume ratio and/or may increase costs of the vapor compression refrigeration cycle.

As such, embodiments of the present disclosure are directed to an improved volume ratio control system that may enhance control of the volume ratio of the compressor without utilizing relatively expensive components. For instance, the volume ratio control system of the present disclosure may include a biasing device, such as a spring, to control a position of a piston disposed within a chamber (e.g., of the compressor). The chamber may be in fluid communication with both a low pressure portion (e.g., suction side) of the compressor and a high pressure portion (e.g., discharge side) of the compressor, such that a pressure differential is generated within the chamber. Under some operating conditions, the pressure differential within the chamber may exceed a threshold, thereby causing the piston to move in a first direction to adjust the volume ratio of the compressor (e.g., increase the volume ratio of the compressor in response to an increase in compression ratio). When the pressure differential falls below the threshold, the biasing device may cause the piston to move in a second direction, opposite the first direction, to adjust the volume ratio of the compressor (e.g., decrease the volume ratio of the compressor in response to a reduction in compression ratio). The piston may be configured to move in the second direction to expose openings that enable refrigerant to bypass a compression portion (e.g., a portion of a compression chamber) of the compressor, such that the volume ratio is reduced when the piston exposes or does not cover the openings. Similarly, the volume ratio of the compressor may be increased when the piston moves in the first direction to cover and/or block the openings, thereby reducing the amount of refrigerant that bypasses the compression portion. The volume ratio control system of the present disclosure is therefore a passive system that utilizes the pressure differential within the chamber along with a resulting biasing force applied to the piston by the biasing device in order to adjust the volume ratio of the compressor. Indeed, the volume ratio control system may be infinitely variable, such that the piston may move toward virtually any position within the chamber and is not limited to predetermined positions.

Turning now to the drawings, FIG. 1 is a perspective view of an embodiment of an environment for a heating, ventilation, air conditioning, and/or refrigeration (HVAC&R) system 10 in a building 12 for a typical commercial setting. The HVAC&R system 10 may include a vapor compression system 14 that supplies a chilled liquid, which may be used to cool the building 12. The HVAC&R system 10 may also include a boiler 16 to supply warm liquid to heat the building 12 and an air distribution system which circulates air through the building 12. The air distribution system can also include an air return duct 18, an air supply duct 20, and/or an air handler 22. In some embodiments, the air handler 22 may include a heat exchanger that is connected to the boiler 16 and the vapor compression system 14 by conduits 24. The heat exchanger in the air handler 22 may receive either heated liquid from the boiler 16 or chilled liquid from the vapor compression system 14, depending on the mode of operation of the HVAC&R system 10. The HVAC&R system 10 is shown with a separate air handler on each floor of building 12, but in other embodiments, the HVAC&R system 10 may include air handlers 22 and/or other components that may be shared between or among floors.

Figure 2:
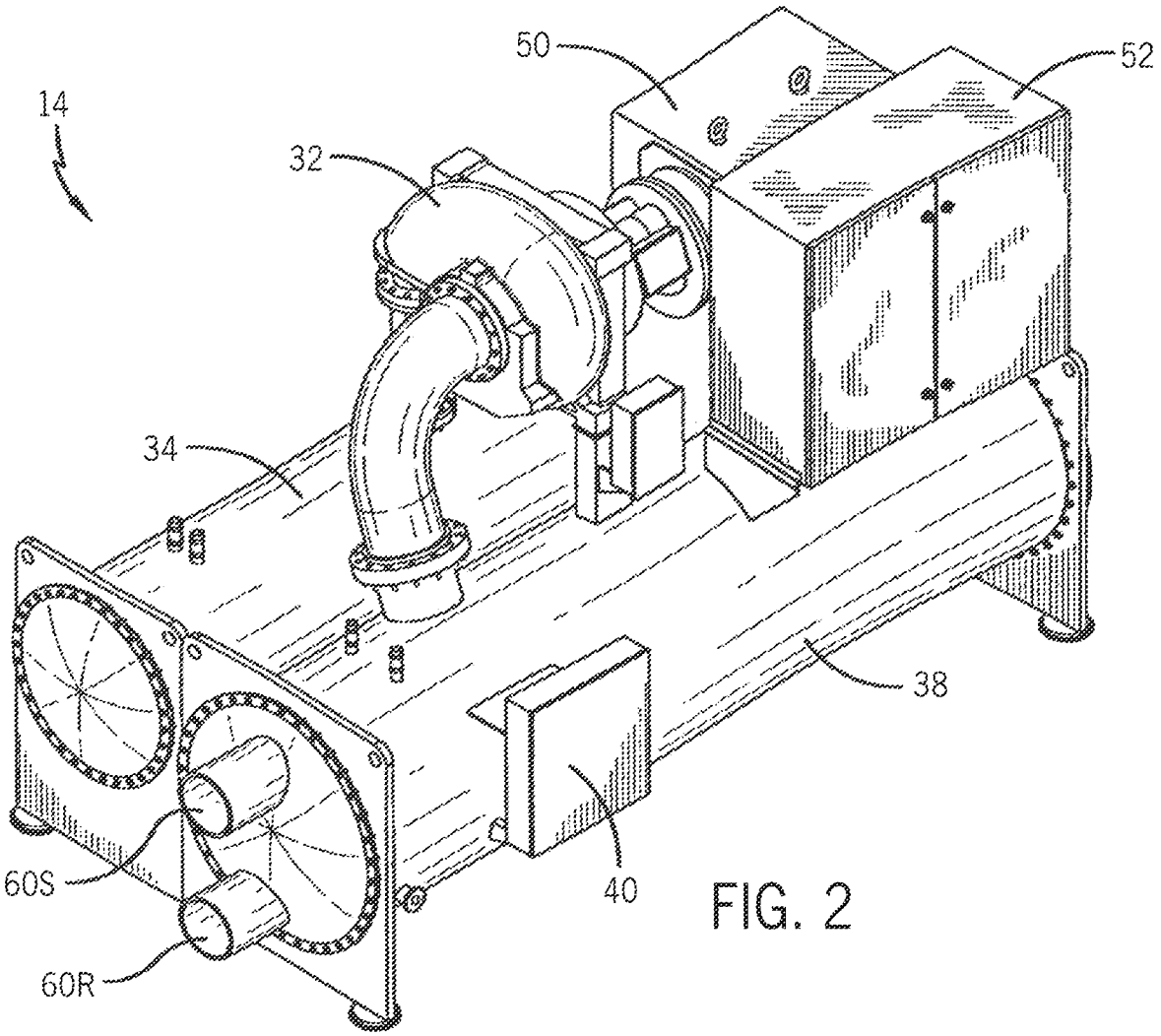
FIG. 2 is a perspective view of an embodiment of a vapor compression system, in accordance with an aspect of the present disclosure.
Figure 3:
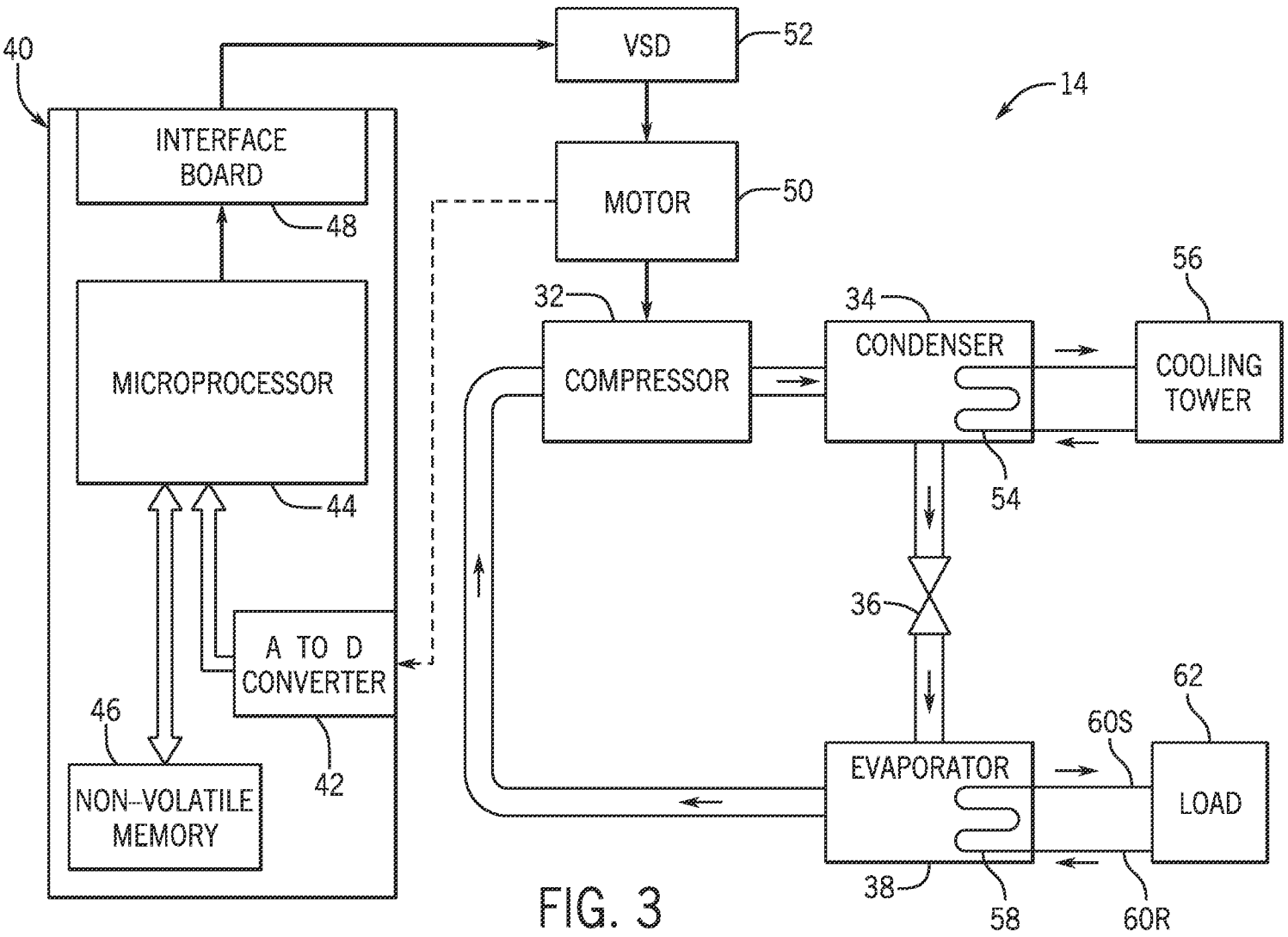
FIG. 3 is a schematic diagram of an embodiment of a vapor compression system, in accordance with an aspect of the present disclosure.

FIGS. 2 and 3 illustrate embodiments of the vapor compression system 14 that can be used in the HVAC&R system 10. The vapor compression system 14 may circulate a refrigerant through a circuit starting with a compressor 32. The circuit may also include a condenser 34, an expansion valve(s) or device(s) 36, and a liquid chiller or an evaporator 38. The vapor compression system 14 may further include a control panel 40 (e.g., a controller) that has an analog to digital (A/D) converter 42, a microprocessor 44, a non-volatile memory 46, and/or an interface board 48.

In some embodiments, the vapor compression system 14 may use one or more of a variable speed drive (VSDs) 52, a motor 50, the compressor 32, the condenser 34, the expansion valve or device 36, and/or the evaporator 38. The motor 50 may drive the compressor 32 and may be powered by a variable speed drive (VSD) 52. The VSD 52 receives alternating current (AC) power having a particular fixed line voltage and fixed line frequency from an AC power source, and provides power having a variable voltage and frequency to the motor 50. In other embodiments, the motor 50 may be powered directly from an AC or direct current (DC) power source. The motor 50 may include any type of electric motor that can be powered by a VSD or directly from an AC or DC power source, such as a switched reluctance motor, an induction motor, an electronically commutated permanent magnet motor, or another suitable motor.

The compressor 32 compresses a refrigerant vapor and delivers the vapor to the condenser 34 through a discharge passage. In some embodiments, the compressor 32 may be a screw compressor. The compressor 32 includes a fluid (e.g., oil) that lubricates components of the compressor. The refrigerant vapor delivered by the compressor 32 to the condenser 34 may transfer heat to a cooling fluid (e.g., water or air) in the condenser 34. The refrigerant vapor may condense to a refrigerant liquid in the condenser 34 as a result of thermal heat transfer with the cooling fluid. The refrigerant liquid from the condenser 34 may flow through the expansion device 36 to the evaporator 38. In the illustrated embodiment of FIG. 3, the condenser 34 is water cooled and includes a tube bundle 54 connected to a cooling tower 56, which supplies the cooling fluid to the condenser 34.

The refrigerant liquid delivered to the evaporator 38 may absorb heat from another cooling fluid, which may or may not be the same cooling fluid used in the condenser 34. The refrigerant liquid in the evaporator 38 may undergo a phase change from the refrigerant liquid to a refrigerant vapor. As shown in the illustrated embodiment of FIG. 3, the evaporator 38 may include a tube bundle 58 having a supply line 60S and a return line 60R connected to a cooling load 62. The cooling fluid of the evaporator 38 (e.g., water, ethylene glycol, calcium chloride brine, sodium chloride brine, or any other suitable fluid) enters the evaporator 38 via return line 60R and exits the evaporator 38 via supply line 60S. The evaporator 38 may reduce the temperature of the cooling fluid in the tube bundle 58 via thermal heat transfer with the refrigerant. The tube bundle 58 in the evaporator 38 can include a plurality of tubes and/or a plurality of tube bundles. In any case, the refrigerant vapor exits the evaporator 38 and returns to the compressor 32 by a suction line to complete the cycle.

Figure 4:
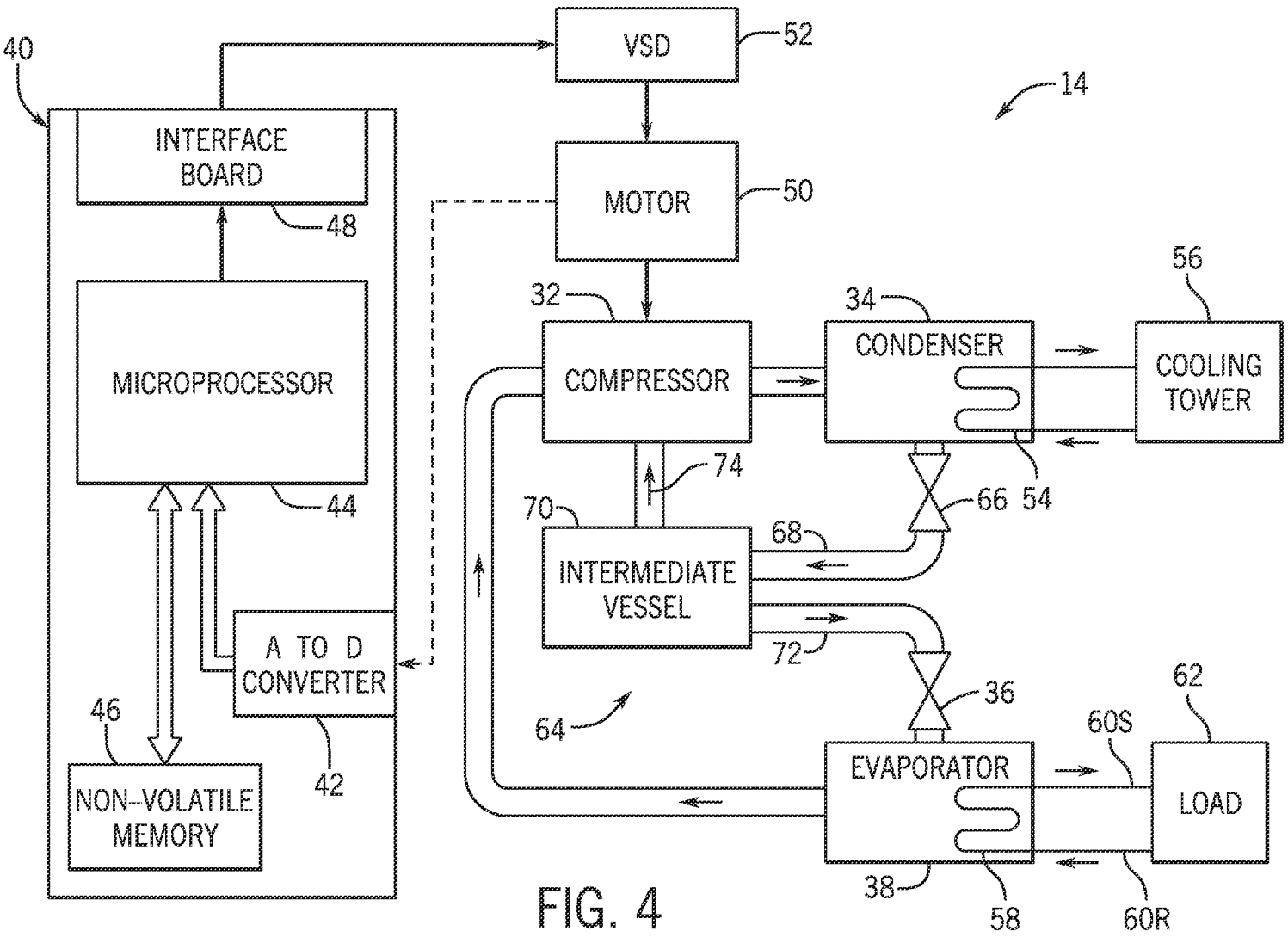
FIG. 4 is a schematic diagram of another embodiment of a vapor compression system, in accordance with an aspect of the present disclosure.

FIG. 4 is a schematic diagram of the vapor compression system 14 with an intermediate circuit 64 incorporated between condenser 34 and the expansion device 36. The intermediate circuit 64 may have an inlet line 68 that is directly fluidly connected to the condenser 34. In other embodiments, the inlet line 68 may be indirectly fluidly coupled to the condenser 34. As shown in the illustrated embodiment of FIG. 4, the inlet line 68 includes a first expansion device 66 positioned upstream of an intermediate vessel 70. In some embodiments, the intermediate vessel 70 may be a flash tank (e.g., a flash intercooler). In other embodiments, the intermediate vessel 70 may be configured as a heat exchanger or a "surface economizer." In the illustrated embodiment of FIG. 4, the intermediate vessel 70 is used as a flash tank, and the first expansion device 66 is configured to lower the pressure of (e.g., expand) the refrigerant liquid received from the condenser 34. During the expansion process, a portion of the liquid may vaporize, and thus, the intermediate vessel 70 may be used to separate the vapor from the liquid received from the first expansion device 66. Additionally, the intermediate vessel 70 may provide for further expansion of the refrigerant liquid because of a pressure drop experienced by the refrigerant liquid when entering the intermediate vessel 70 (e.g., due to a rapid increase in volume experienced when entering the intermediate vessel 70). The vapor in the intermediate vessel 70 may be drawn by the compressor 32 through a suction line 74 of the compressor 32. In other embodiments, the vapor in the intermediate vessel may be drawn to an intermediate stage of the compressor 32 (e.g., not the suction stage). The liquid that collects in the intermediate vessel 70 may be at a lower enthalpy than the refrigerant liquid exiting the condenser 34 because of the expansion in the expansion device 66 and/or the intermediate vessel 70. The liquid from intermediate vessel 70 may then flow in line 72 through a second expansion device 36 to the evaporator 38.

As discussed above, embodiments of the present disclosure are directed to an improved volume ratio control system for a compressor, such as the compressor 32. The volume ratio control system may include a piston disposed within a chamber of the compressor that is in fluid communication with a low pressure portion (e.g., suction side or suction portion) and a high pressure portion (e.g., discharge side or discharge portion) of the compressor. As such, a pressure differential may be established within the chamber to control a position of the piston with respect to opposing ends of the chamber. The piston may further be coupled to a biasing device, such as a spring, which may direct movement of the piston in response to the pressure differential within the chamber falling below a threshold value. As used herein, the threshold value of the pressure differential may be a function of a biasing force, such as a spring constant, of the biasing device and/or a position of the piston within the chamber. Indeed, the threshold value of the pressure differential may change based at least on a current length and/or a current level of extension of the biasing device. For instance, the biasing force exerted by the biasing device may change as the biasing device extends and/or contracts from a natural or unbiased position (e.g., the biasing force increases as the biasing device moves further from the natural or unbiased position).

In any case, the volume ratio control system is passive in that the volume ratio control system adjusts the volume ratio of the compressor as a result of the pressure differential within the chamber, which may be indicative of the compression ratio of the compressor. In other words, additional mechanical and/or electrical components, such as valves, motors, processors, memory devices, sensors, and/or other devices, may not be included in order to adjust the volume ratio of the compressor. Further, the volume ratio control system is generally infinitely variable because a position of the piston within the chamber is not limited to stepwise or predetermined positions. Therefore, the volume ratio control system enables narrowly-tailored, accurate, and/or precise volume ratio control of the compressor without including relatively expensive components that add costs to the vapor compression system.

Figure 5:
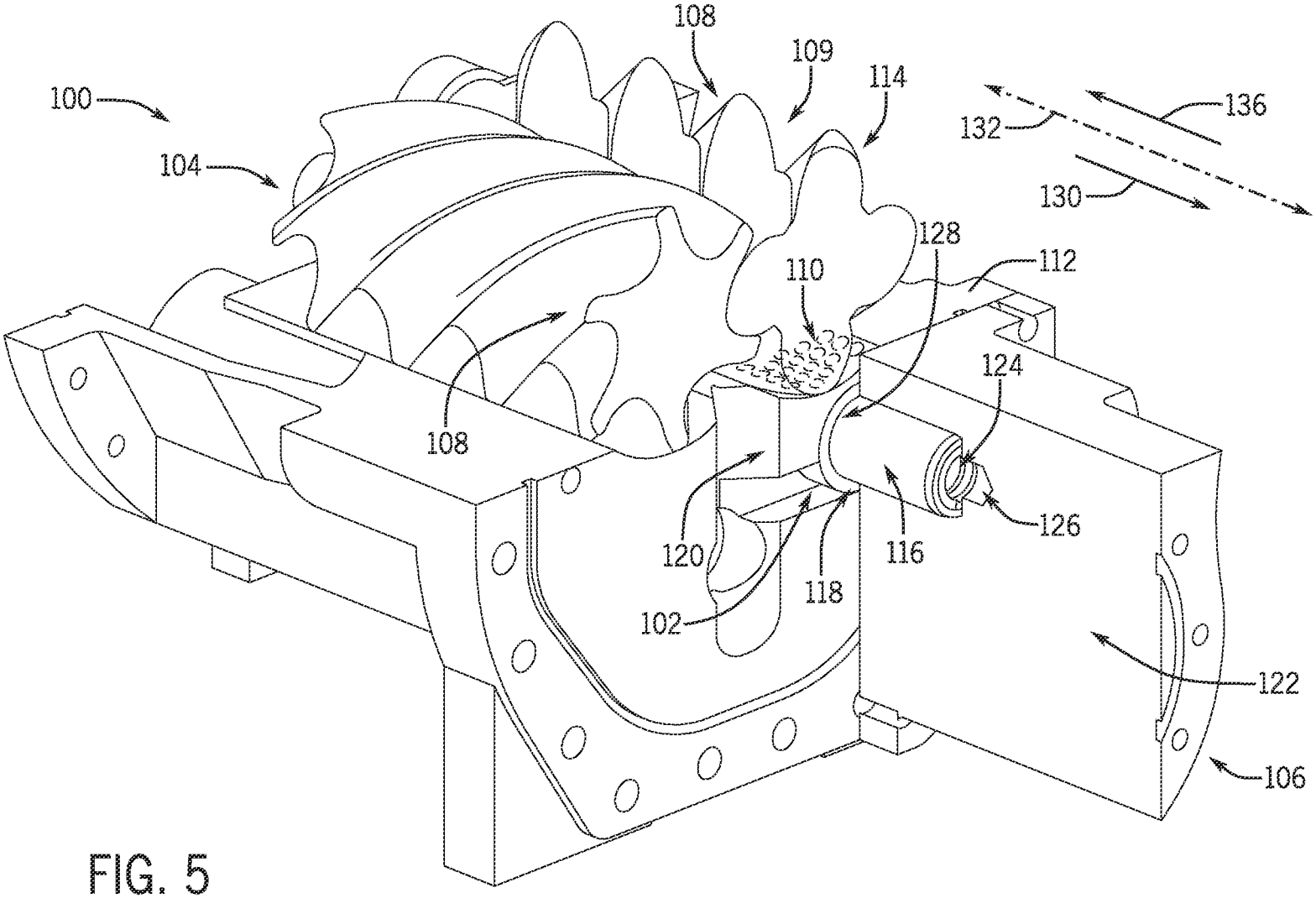
FIG. 5 is a cutaway perspective view of an embodiment of a compressor having a volume ratio control system that may be included in a vapor compression system, in accordance with an aspect of the present disclosure.

For example, FIG. 5 is a cutaway perspective view of an embodiment of a compressor 100, such as the compressor 32, having a volume ratio control system 102 in accordance with present techniques. The compressor 100 may include a low pressure side 104 (e.g., suction side) that draws refrigerant from a component disposed along a refrigerant circuit of the vapor compression system 14 (e.g., from the evaporator 38) and a high pressure side 106 (e.g., discharge side) that directs high-pressure refrigerant toward a component disposed along the refrigerant circuit (e.g., toward the condenser 34). The low pressure side 104 of the compressor 100 may include rotors 108 that are configured to rotate and compress the refrigerant, thereby increasing the pressure of the refrigerant exiting the compressor 100 via a discharge port positioned on the high pressure side 106. For instance, the rotors 108 may be driven into rotation via a motor. As the rotors 108 rotate, threads or lobes of the rotors 108 may reduce a volume of the refrigerant within a compression chamber 109 of the compressor 100, which in turn, increases the pressure of the refrigerant.

Figure 6:
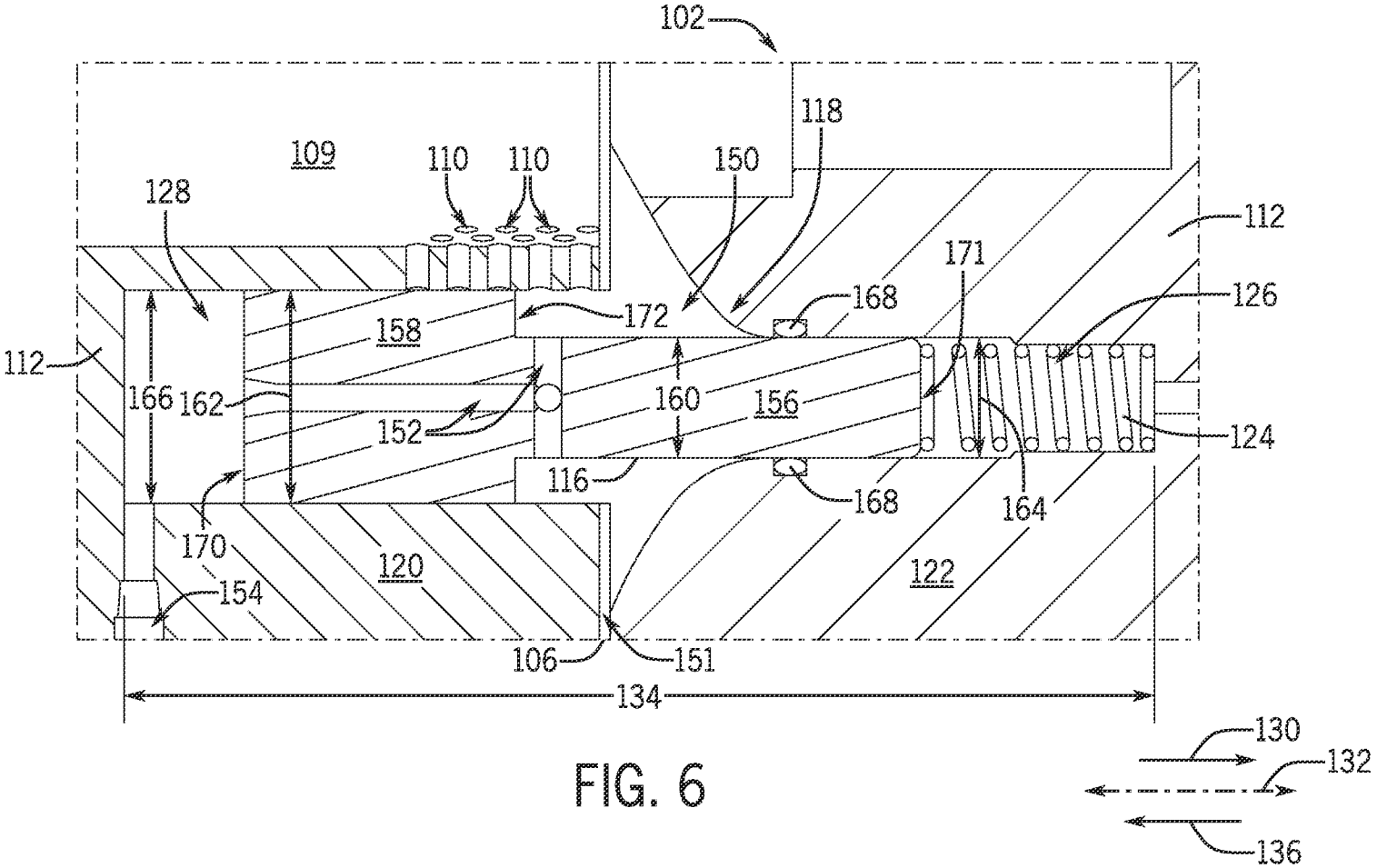
FIG. 6 is a cross-sectional schematic diagram of an embodiment of a volume ratio control system for a compressor, in accordance with an aspect of the present disclosure.

As shown the illustrated embodiment of FIGS. 5 and 6, the compressor 100 includes openings 110 formed in a housing 112 of the compressor 100 that enable refrigerant to bypass at least a portion 114 of the compression chamber 109 and direct the refrigerant toward the high pressure side 106. In other words, refrigerant flowing through the openings 110 may reduce an amount of refrigerant that is ultimately further compressed by the rotors 108, thereby reducing a volume ratio of the compressor 100. The volume ratio control system 102 is configured to adjust an amount of the refrigerant within the compressor 100 that flows through the openings 110 and bypasses at least the portion 114 of the compression chamber 109. For example, the volume ratio control system 102 includes a piston 116 disposed within a chamber 118 formed in the housing 112. The chamber 118 may be in fluid communication with the openings 110 and may extend into a first portion 120 of the housing 112 that is proximate to the low pressure side 104. Additionally, the chamber 118 may extend into a second portion 122 of the housing 112 that is proximate to the high pressure side 106. In any case, the piston 116 is configured to move within the chamber 118 to block and/or expose the openings 110 to control the amount of refrigerant bypassing the portion 114 of the compression chamber 109.

As is described in further detail herein, movement of the piston 116 within the chamber 118 may be passively controlled by a biasing device 124 (e.g., a spring) and/or a pressure differential between a first portion 126 of the chamber 118 (e.g., fluidly coupled to the low pressure side 104 of the compressor 100, such as via ports, conduits, etc.) and a second portion 128 of the chamber 118 (e.g., fluidly coupled to the high pressure side 106 of the compressor 100, such as via ports, conduits, etc.). For example, the first portion 126 may include a relatively low pressure associated with refrigerant entering the compressor 100 on the low pressure side 104, whereas the second portion 128 may include a relatively high pressure associated with refrigerant exiting the compressor 100 on the high pressure side 106. The pressure differential between the first portion 126 and the second portion 128 may direct movement of the piston 116 within the chamber 118 upon reaching and/or exceeding a threshold pressure differential (e.g., a variable pressure differential threshold). For example, when the pressure differential is at and/or exceeds the threshold pressure differential, a force is exerted on the piston 116 to direct movement of the piston 116 in a first direction 130 along an axis 132 defining a length 134 (see, e.g., FIG. 6) of the chamber 118. As the piston 116 moves in the first direction 130, the piston 116 may block and/or cover one or more of the openings 110 to the chamber 118 (e.g., block refrigerant from bypassing the portion 114 of the rotors 108 and/or compression chamber 109 by flowing through the openings 110). Accordingly, as the compression ratio of the compressor 100 increases, the volume ratio is increased by the volume ratio control system 102 to maintain a desired performance (e.g., efficiency) of the compressor 100.

Further, the biasing device 124 exerts a force on the piston 116 that may direct movement of the piston 116 in a second direction 136, opposite the first direction 130, along the axis 132 in response to the pressure differential between the first portion 126 and the second portion 128 falling below the pressure differential threshold (e.g., a variable pressure differential threshold). For example, the biasing device 124 may include target parameters that apply a target biasing force on the piston 116 at various positions within the chamber 118 to enable movement of the piston 116 in the second direction 136 when the pressure differential between the first portion 126 and the second portion 128 falls below the pressure differential threshold for the given position of the piston 116 within the chamber 118. The target parameters of the biasing device 124 may include a material (e.g., metal, polymer) of the biasing device 124, a coil diameter of the biasing device 124, an internal diameter of the biasing device 124, an external diameter of the biasing device 124, a coil pitch of the biasing device 124, a number of coils of the biasing device 124, a spring constant of the biasing device 124, a free length of the biasing device 124, a block length of the biasing device 124, another suitable parameter of the biasing device 124, or any combination thereof. In any case, the pressure differential between the portions 126, 128 as well as the target biasing force of the biasing device 124 may passively direct movement of the piston 116 within the chamber 118 to adjust the volume ratio of the compressor 100.

FIG. 6 is a schematic diagram of a cross-section of a portion of the compressor 100, illustrating the chamber 118 of the volume ratio control system 102. As shown in the illustrated embodiment of FIG. 6, the piston 116 is disposed within the chamber 118 and is exposed to the first portion 126 and the second portion 128. The chamber 118 may also include a bypass portion 150 fluidly coupled to the high pressure side 106 of the compressor 100 and/or the second portion 128. In some embodiments, the piston 116 may include a passage 152 that enables fluid communication between the second portion 128 of the chamber 118 and the bypass portion 150. In any case, the bypass portion 150 fluidly couples the openings 110 and the high pressure side 106 of the compressor 100 via a bypass line 151 and enables refrigerant flowing through the openings 110 to flow toward the high pressure side 106 of the compressor 100. Accordingly, a pressure within the bypass portion 150 of the chamber 118 may be substantially equal to (e.g., within 10% of, within 5% of, or within 1% of) a discharge pressure of the compressor 100 because the bypass portion 150 is fluidly coupled to the high pressure side 106 of the compressor 100.

In some embodiments, the second portion 128 may be fluidly coupled to a lubricant line 154 that enables a lubricant (e.g., oil) to flow into and out of the second portion 128 (e.g., in addition to, or in lieu, of refrigerant from the bypass portion 150). The lubricant may be supplied from other components and/or locations of the compressor 100 (e.g., a lubricant circuit, bearings, a sump, or another suitable location) and may include a pressure that is substantially equal to (e.g., within 10% of, within 5% of, or within 1% of) the discharge pressure of the compressor 100. Thus, both the second portion 128 and the bypass portion 150 may include a pressure that is substantially equal to the discharge pressure of the compressor 100. In other embodiments, the volume ratio control system 102 may not include the lubricant line 154, such that the second portion 128 is directly fluidly coupled to the bypass portion 150 (see, e.g., FIG. 7).

In any case, the piston 116 includes a first segment 156 and a second segment 158 that are each configured to move (e.g., jointly) in the first direction 130 and the second direction 136 within the chamber 118. The first segment 156 may include a first diameter 160 that is less than a second diameter 162 of the second segment 158. In some embodiments, the first diameter 160 of the first segment 156 corresponds to a third diameter 164 of the first portion 126 of the chamber 118, and the second diameter 162 of the second segment 158 corresponds to a fourth diameter 166 of the second portion 128 of the chamber 118. For instance, the first diameter 160 may be slightly less than the third diameter 164 to enable the first segment 156 of the piston 116 to move along the axis 132 within the first portion 126 of the chamber 118. Similarly, the second diameter 162 may be slightly less than the fourth diameter 166 to enable the second segment 158 of the piston 116 to move along the axis 132 within the second portion 128 of the chamber 118. Further, the chamber 118 and/or the piston 116 may include one or more seals 168 that are configured to seal the first portion 126, the second portion 128, and/or the bypass portion 150 from one another. As such, a pressure differential created by refrigerant between the first portion 126 and the second portion 128 and/or between the first portion 126 and the bypass portion 150 may be maintained within the chamber 118.

As shown in the illustrated embodiment of FIG. 6, a surface 170 of the second segment 158 of the piston 116 is exposed to the second portion 128 of the chamber 118, and thus, lubricant and/or refrigerant within the second portion 128 of the chamber 118. The lubricant and/or refrigerant in the second portion 128 may include a pressure that is substantially equal to the discharge pressure of refrigerant exiting the compressor 100. As such, the lubricant and/or refrigerant may apply a pressure force against the surface 170 to direct movement of the piston 116 in the first direction 130 when the pressure differential between the first portion 126 and the second portion 128 exceeds the pressure differential threshold. Accordingly, movement of the piston 116 in the first direction 130 may cover and/or block the openings 110 to block refrigerant from bypassing the portion 114 of the compression chamber 109 and entering the bypass portion 150 of the chamber 118. Further, when the pressure differential between the first portion 126 and the second portion 128 falls below the pressure differential threshold, the biasing device 124 may apply a force to the piston 116 in the second direction 136 to direct movement of the piston 116 in the second direction 136 within the chamber 118 to expose one or more of the openings 110, and thus, enable refrigerant to bypass the portion 114 of the compression chamber 109 and enter the bypass portion 150. The refrigerant flowing through the one or more exposed openings 110 may then be directed toward the high pressure side 106 of the compressor via the bypass line 151.

In some embodiments, the biasing device 124 (e.g., a spring) may be coupled to an end 171 of the first segment 156, as shown in FIG. 6. The biasing device 124 may be formed into the end 171, welded to the end 171, fastened to the end 171 via fasteners (e.g., screws, bolts, or other suitable fasteners), or coupled to the end 171 via another suitable technique. In other embodiments, the biasing device 124 may extend into a portion or cavity of the first segment 156 of the piston 116 (see, e.g., FIGS. 7 and 8). In any case, the biasing device 124 exerts a force on the piston 116 in the second direction 136 or toward a natural and/or resting position (e.g., unbiased position) of the biasing device 124. As the piston 116 is directed in the first direction 130, the biasing device 124 may compress and exert a greater force on the piston 116. As such, the pressure differential threshold that drives movement of the piston 116 may vary based on an amount of compression of the biasing device 124 and/or a current length of the biasing device 124 compared to a natural or unbiased length of the biasing device 124.

Further, as shown in the illustrated embodiment of FIG. 6, the second segment 158 of the piston 116 includes the surface 170 (e.g., a first surface) positioned proximate to the second portion 128 and a second surface 172 positioned proximate to the bypass portion 150. As should be understood, the pressure within the bypass portion 150 and the pressure within the second portion 128 of the chamber 118 are substantially equal to one another. Additionally, a surface area of the surface 170 is greater than a surface area of the second surface 172. While the pressures within the bypass portion 150 and the second portion 128 are substantially equal, an increased pressure force may be applied to the surface 170 when compared to the second surface 172 due to the increased surface area of the surface 170. Accordingly, as the discharge pressure of the compressor 100 increases, the pressure differential between the first portion 126 and the second portion 128 of the chamber 118 may increase and cause the piston 116 to move in the first direction 130.

Figure 7:
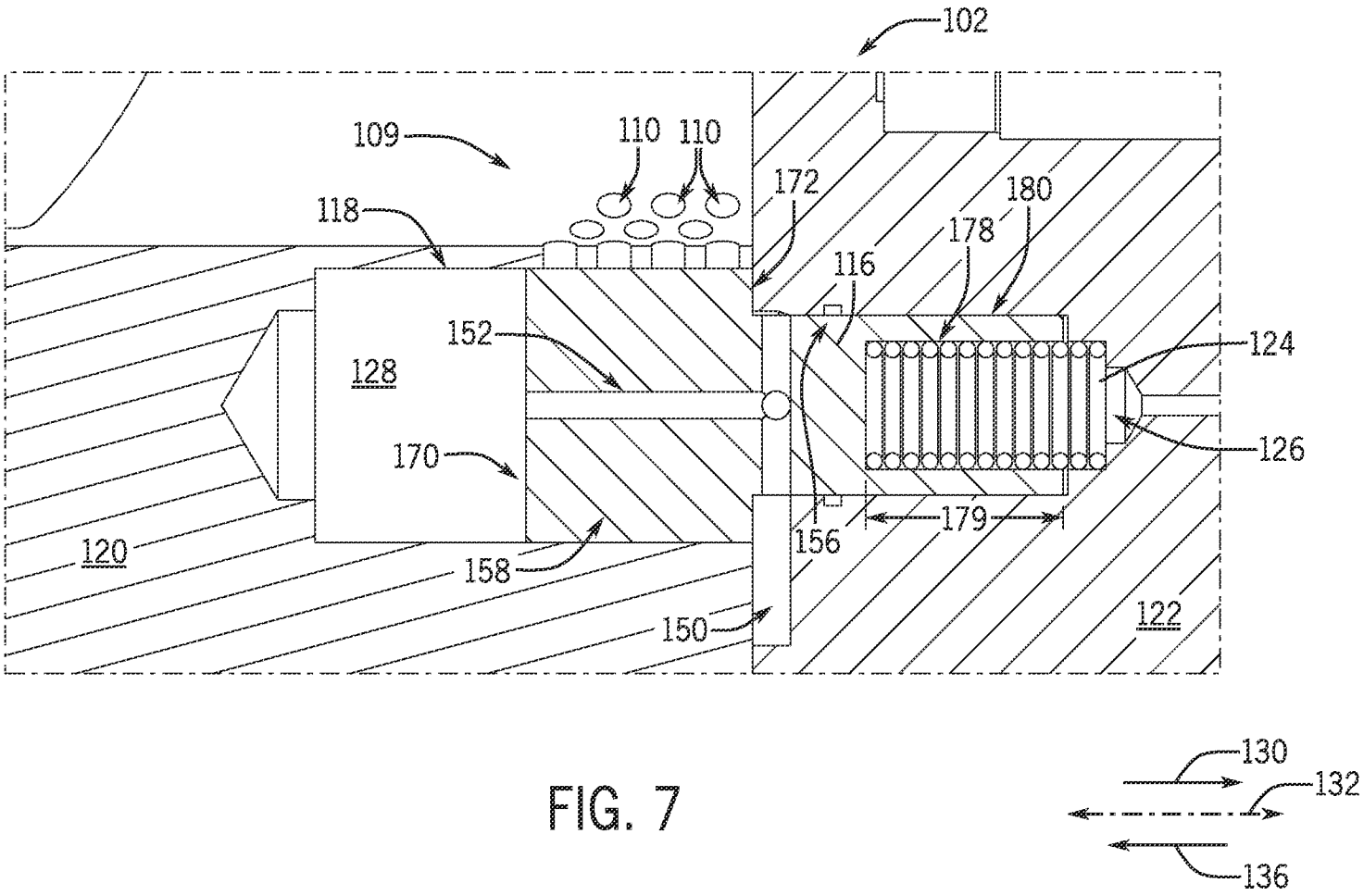
FIG. 7 is a cross-sectional schematic diagram of an embodiment of a volume ratio control system for a compressor in a first position, in accordance with an aspect of the present disclosure.

FIG. 7 is a schematic of an embodiment of the volume ratio control system 102 that does not include the lubricant line 154 fluidly coupled to the second portion 128 of the chamber 118. Accordingly, both the bypass portion 150 and the second portion 128 of the chamber 118 may include refrigerant (or a refrigerant and lubricant mixture) received from the openings 110 and/or the high pressure side 106 of the compressor 100 (e.g., via the bypass line 151). Eliminating the lubricant line 154 from the volume ratio control system 102 may facilitate simplified machining the chamber 118 and/or other components of the volume ratio control system 102 into the compressor 100. Further, the illustrated embodiment of the volume ratio control system 102 of FIG. 7 shows the biasing device 124 disposed within a cavity 178 of the first segment 156 of the piston 116. In some embodiments, the biasing device 124 may be coupled to a surface of the cavity 178 via a weld, a fastener, or another suitable coupling technique. In other embodiments, the cavity 178 may include a length 179 that is configured to hold the biasing device 124 within the cavity 178 regardless of the position of the piston 116 within the cavity 178. In other words, the length 179 of the cavity 178 may enable the biasing device 124 to remain within the cavity 178 without physically coupling the biasing device 124 to a surface of the cavity 178 and/or another portion of the piston 116.

As shown in the illustrated embodiment of FIG. 7, refrigerant (or a refrigerant and lubricant mixture) may flow into and out of the bypass portion 150 via the passage 152 extending through the piston 116. Accordingly, a first pressure within the bypass portion 150 and a second pressure within the second portion 128 of the chamber 118 may be substantially equal (e.g., the bypass portion 150 and the second portion1 128 are in fluid communication with one another via the passage 152). Thus, the volume ratio control system 102 of FIG. 7 may operate substantially the same as the embodiment of the volume ratio control system 102 illustrated in FIG. 6. For instance, as the pressure differential between the first portion 126 and the second portion 128 of the chamber 118 increases, a pressure force is applied to the surface 170 of the second segment 158 of the piston 116 to move the piston 116 in the first direction 130. As the piston 116 moves in the first direction 130, the second segment 158 of the piston 116 covers and/or blocks one or more of the openings 110, thereby blocking refrigerant from bypassing the portion 114 of the rotors 108. As shown in the illustrated embodiment of FIG. 7, the piston 116 is in a fully closed position 180, such that all of the openings 110 are covered by the second segment 158 of the piston 116. Therefore, the compressor 100 may operate at an increased or maximum volume ratio because no refrigerant bypasses the portion 114 of the compression chamber 109.

Figure 8:
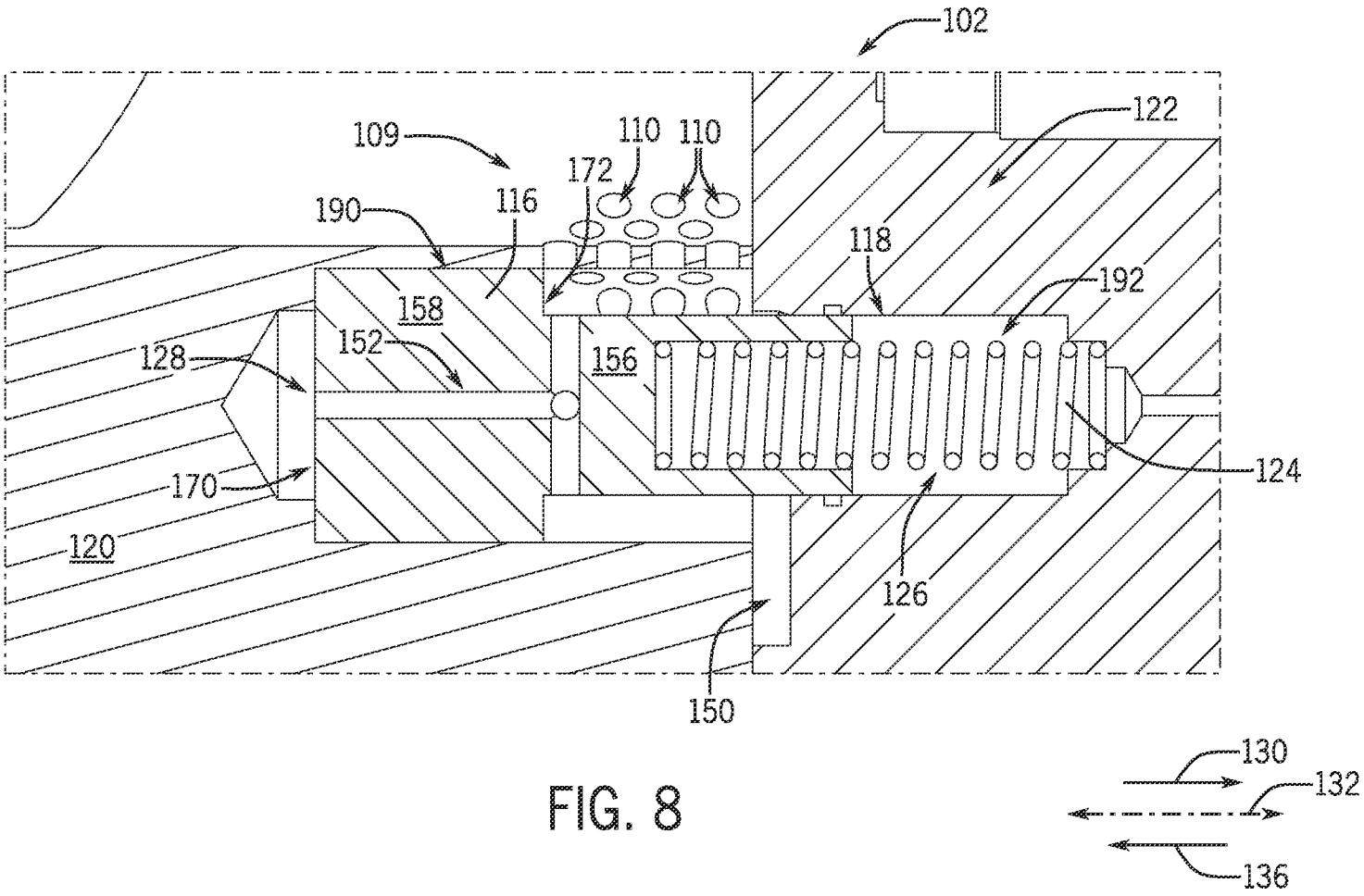
FIG. 8 is a cross-sectional schematic diagram of an embodiment of a volume ratio control system for a compressor in a second position, in accordance with an aspect of the present disclosure.

As the pressure differential between the first portion 126 and the second portion 128 decreases, the biasing device 124 may direct the piston 116 to move in the second direction 136 by applying a force on the first segment 156 of the piston 116 in the second direction 136. For example, FIG. 8 is a schematic of the volume ratio control system 102 of FIG. 7 with the piston in a fully open position 190. As shown in the illustrated embodiment of FIG. 8, the biasing device 124 is in an extended position 192 (e.g., a natural or resting position) and exerts a force on the piston 116 (e.g., the first segment 156 of the piston 116) in the second direction 136. As discussed above, an amount of force exerted on the piston 116 by the biasing device 124 may be based on a position of the piston 116 within the chamber 118 along the axis 132, an amount of extension and/or compression of the biasing device 124, parameters of the basing device 124 itself, or suitable parameters, or any combination thereof. For instance, parameters of the biasing device 124 that may contribute to the biasing force applied to the piston 116 may include the biasing force of the biasing device 124, which may be based on a material (e.g., metal, polymer) of the biasing device 124, a coil diameter of the biasing device 124, an internal diameter of the biasing device 124, an external diameter of the biasing device 124, a coil pitch of the biasing device 124, a number of coils of the biasing device 124, a spring constant of the biasing device 124, a free length of the biasing device 124, a block length of the biasing device 124, another suitable parameter of the biasing device 124, or any combination thereof.

In any case, both the pressure differential within the chamber 118 (e.g., between the first portion 126 and the second portion 128) applying a force on the surface 170 of the piston 116 in the first direction 130 and the biasing force applied to the piston 116 by the biasing device 124 in the second direction 136 control movement and the position of the piston 116 within the chamber 118. The pressure differential threshold for directing movement of the piston 116 in the first direction 130 may vary based on the position of the piston 116 and/or the level of extension and/or compression of the biasing device 124. As such, the piston 116 may be positioned (e.g., stationary) at virtually any location within the chamber 118 along the axis 132 when the opposing forces applied by the pressure differential and the biasing device 124 are substantially equal. Thus, the volume ratio control system 102 of the present disclosure may enable infinitely variable control of the volume ratio of the compressor 100.

As set forth above, embodiments of the present disclosure may provide one or more technical effects useful in controlling a volume ratio of a compressor. For example, embodiments of the present disclosure are directed to an improved volume ratio control system that may operate passively and enable infinitely variable control of the volume ratio. The volume ratio control system may include a piston disposed within a chamber of the compressor. The chamber may include a first portion fluidly coupled to a low pressure side of the compressor, a bypass portion fluidly coupled to a high pressure side of the compressor, and/or a second portion fluidly coupled to the bypass portion and/or a lubricant line. As the compressor operates, a pressure differential may be established between the first portion of the chamber and the second portion of the chamber. When the pressure differential exceeds a threshold, the pressure differential may exert a force on the piston in a first direction causing the piston to block or cover openings that enable refrigerant to bypass at least a portion of a compression chamber of the compressor. As such, a volume ratio of the compressor is increased. When the pressure differential falls below the threshold, a biasing force coupled to the piston may apply a force to the piston in a second direction, opposite the first direction, to unblock or expose the openings. As such, the pressure ratio of the compressor is reduced. In any case, the volume ratio control system enables passive control of the volume ratio of the compressor, which reduces costs and also enhances control over the volume ratio of the compressor. The technical effects and technical problems in the specification are examples and are not limiting. It should be noted that the embodiments described in the specification may have other technical effects and can solve other technical problems.

While only certain features and embodiments of the invention have been illustrated and described, many modifications and changes may occur to those skilled in the art (e.g., variations in sizes, dimensions, structures, shapes and proportions of the various elements, values of parameters (e.g., temperatures, pressures, etc.), mounting arrangements, use of materials, colors, orientations, etc.) without materially departing from the novel teachings and advantages of the subject matter recited in the claims. The order or sequence of any process or method steps may be varied or re-sequenced according to alternative embodiments. It is, therefore, to be understood that the appended claims are intended to cover all such modifications and changes as fall within the true spirit of the invention. Furthermore, in an effort to provide a concise description of the exemplary embodiments, all features of an actual implementation may not have been described (i.e., those unrelated to the presently contemplated best mode of carrying out the invention, or those unrelated to enabling the claimed invention). It should be appreciated that in the development of any such actual implementation, as in any engineering or design project, numerous implementation specific decisions may be made. Such a development effort might be complex and time consuming, but would nevertheless be a routine undertaking of design, fabrication, and manufacture for those of ordinary skill having the benefit of this disclosure, without undue experimentation.

The techniques presented and claimed herein are referenced and applied to material objects and concrete examples of a practical nature that demonstrably improve the present technical field and, as such, are not abstract, intangible or purely theoretical. Further, if any claims appended to the end of this specification contain one or more elements designated as "means for [perform]ing [a function] . . . " or "step for [perform]ing [a function] . . . ", it is intended that such elements are to be interpreted under 35 U.S.C. 112(f). However, for any claims containing elements designated in any other manner, it is intended that such elements are not to be interpreted under 35 U.S.C. 112(f).

The invention claimed is:

1. A volume ratio control system for a compressor, comprising:

a chamber formed within a housing of the compressor;

a piston disposed within the chamber, wherein the piston is configured to fluidly separate the chamber into at least a first portion fluidly coupled to a low pressure side of the compressor and a second portion fluidly coupled to a high pressure side of the compressor; and a biasing device configured to adjust a position of the piston within the chamber in response to a pressure differential between the low pressure side of the compressor and the high pressure side of the compressor falling below a threshold value wherein the threshold value is a variable threshold value.

2. The volume ratio control system of claim 1, wherein the low pressure side is a suction side of the compressor, and the high pressure side is a discharge side of the compressor.

3. The volume ratio control system of claim 1, wherein the biasing device is disposed within a cavity.

4. The volume ratio control system of claim 1, wherein the chamber comprises one or more openings formed in the housing, wherein the one or more openings are fluidly coupled to a compression chamber of the compressor.

5. The volume ratio control system of claim 4, wherein the biasing device is configured to adjust the position of the piston to expose at least an opening of the one or more openings in response to the pressure differential between the low pressure side of the compressor and the high pressure side of the compressor falling below the threshold value.

6. The volume ratio control system of claim 1, wherein the threshold value is a variable threshold value dependent on an amount of compression of the biasing device.

7. The volume ratio control system of claim 1, wherein the piston comprises a first segment having a first diameter and a second segment having a second diameter, wherein the first diameter is less than the second diameter.

8. The volume ratio control system of claim 1, wherein the piston is configured to separate the chamber into the first portion, the second portion, and a bypass portion, and the piston is configured to fluidly separate the first portion from the bypass portion.

9. The volume ratio control system of claim 8, wherein the bypass portion is fluidly coupled to the high pressure side of the compressor.

10. The volume ratio control system of claim 8, wherein the bypass portion is fluidly coupled to the second portion via a passage extending through the piston.

11. The volume ratio control system of claim 8, wherein the second portion is fluidly coupled to the high pressure side of the compressor and to a lubricant line of the compressor.

12. The volume ratio control system of claim 11, wherein the lubricant line is configured to supply a lubricant to the second portion of the chamber at a pressure substantially equal to a discharge pressure of the compressor.

13. A heating, ventilation, air conditioning, and/or refrigeration (HVAC&R) system, comprising:

a compressor configured to circulate a refrigerant through a refrigerant circuit; and a volume ratio control system configured to adjust a volume ratio of the compressor, wherein the volume ratio control system comprises:

a chamber;

a piston disposed within the chamber, wherein the piston fluidly separates the chamber into at least a first portion fluidly coupled to a low pressure side of the compressor and a second portion fluidly coupled to a high pressure side of the compressor; and a biasing device disposed within the chamber, wherein the biasing device is configured to enable movement of the piston in response to a pressure differential between the low pressure side of the compressor and the high pressure side of the compressor falling below a threshold value wherein the threshold value is a variable threshold value.

14. The HVAC&R system of claim 13, wherein the chamber is formed within a housing of the compressor.

15. The HVAC&R system of claim 14, wherein the chamber comprises one or more openings formed in the housing and fluidly coupled to a compression chamber of the compressor.

16. The HVAC&R system of claim 15, wherein the biasing device is configured to enable movement of the piston in a first direction to expose at least an opening of the one or more openings in response to the pressure differential between the low pressure side of the compressor and the high pressure side of the compressor falling below the threshold value.

17. The HVAC&R system of claim 16, wherein the biasing device is configured to enable movement of the piston in a second direction, opposite the first direction, in response to the pressure differential exceeding the threshold value.

18. The HVAC&R system of claim 13, wherein the compressor is a screw compressor.

19. The HVAC&R system of claim 13, wherein the volume ratio control system is configured to passively adjust the volume ratio of the compressor based on the pressure differential between the low pressure side of the compressor and the high pressure side of the compressor and based on the biasing device.

20. A volume ratio control system for a compressor, comprising:

a chamber formed within a housing of the compressor, wherein the chamber comprises a first portion, a second portion, and a bypass portion, the first portion is fluidly coupled to a low pressure side of the compressor, the bypass portion is fluidly coupled to a high pressure side of the compressor, and the second portion fluidly coupled to the bypass portion and/or to a lubricant line;

a piston disposed within the chamber, wherein the piston fluidly separates the first portion of the chamber from the second portion of the chamber; and a biasing device disposed within the chamber, wherein the biasing device is configured to direct movement of the piston in response to a pressure differential between the low pressure side of the compressor and the high pressure side of the compressor falling below a threshold value wherein the threshold value is a variable threshold value.

21. The volume ratio control system of claim 20, wherein the piston comprises a first segment having a first diameter and a second segment having a second diameter, wherein the first segment is coupled to the biasing device, and wherein the first diameter is less than the second diameter.

22. The volume ratio control system of claim 21, wherein the first segment of the piston is disposed in at least the first portion of the chamber, and wherein the second segment of the piston is disposed in at least the second portion of the chamber.

23. The volume ratio control system of claim 22, wherein the second segment of the piston comprises a first surface facing the second portion of the chamber and a second surface facing the bypass portion of the chamber, and wherein the first segment of the piston extends from the second surface of the second segment.

* * * * *